US005398471A

United States Patent [19]

Spagnolo

[11] Patent Number: 5,398,471

[45] Date of Patent: Mar. 21, 1995

[54] BUILDING PRODUCTS

[75] Inventor: Pasquale Spagnolo, Unionville, Canada

[73] Assignee: Ontario Limited, Norht York, Canada

[21] Appl. No.: 865,933

[22] Filed: Apr. 9, 1992

[30] Foreign Application Priority Data

Apr. 10, 1991 [CA] Canada ..... 2040124

[51] Int. Cl.[6] ..... E04B 2/00; E04B 5/00; E04B 7/00; E04B 9/00

[52] U.S. Cl. ..... 52/412; 52/408; 52/268; 52/273; 52/274; 52/741.4; 52/745.05; 52/746

[58] Field of Search ..... 52/741.4, 745.05, 746, 52/408, 412, 268, 269, 273, 274, 169.14, 264, 293.3

[56] References Cited

U.S. PATENT DOCUMENTS

| | | | |
|---|---|---|---|
| 112,376 | 3/1871 | Phillips | 52/412 |
| 584,865 | 6/1897 | Fisher | 52/169.14 |
| 791,775 | 6/1905 | Hansell | 52/412 |
| 4,194,328 | 3/1980 | Peirson et al. . | |
| 4,599,830 | 7/1986 | Nawrot . | |
| 4,843,786 | 7/1989 | Walkinshaw et al. . | |
| 4,907,386 | 3/1990 | Ekroth | 52/169.14 |
| 5,091,235 | 2/1992 | Vergnano | 52/408 X |

FOREIGN PATENT DOCUMENTS 2136844 9/1984 United Kingdom .

OTHER PUBLICATIONS

Seal Tight Premoulded Membrane TM Catalog 1959 Catalog No. 1660 Oct./1959 pp. 1-8.

Housing Code for the Province of Ontario pp. 11-4 to 11-14.

Housing Code for the Province of Ontario pp. 9-113 to 9-118.

*Primary Examiner*—Carl D. Friedman

*Assistant Examiner*—Robert Canfield

*Attorney, Agent, or Firm*—Ivor M. Hughes; Neil H. Hughes

[57] ABSTRACT

A building having interior and exterior walls, the building comprising supporting members, a continuous vapor barrier and a continuous air barrier, the continuous air barrier being formed by the continuous vapor barrier with supplementary air permeable membrane portions positioned with the building when formed, the supplementary membrane portions extending between the interior and exterior walls extending between abutting supporting members disposed proximate the floor, foundation wall, and preferably the ceiling of the building when completed, the supplementary membrane portion continuously extending from under the cladding of the exterior wall to under the vapor barrier of the interior wall between the abutting supporting members, and thereby with the continuous vapor barrier providing a continuous air barrier for the building.

3 Claims, 1 Drawing Sheet

R
A
P1
M1
1
C
P2
V
1
I1
2
P3
B
10
M2
F1
J2
I2
P3a
P4
2
C
V
T
I3
20
3
M3
P5
F2
J1
I4
P6
W1
F4
3
V
G
W

BUILDING PRODUCTS

FIELD OF INVENTION

This invention relates to building, and to specifically a method of constructing a building and the structure thereof, by providing a continuous air permeable barrier that includes the use in part of a vapour barrier as part of the continuous barrier with the provision of supplementary portions used adjacent the floor, ceiling and foundation wall of the building.

BACKGROUND OF THE INVENTION

The housing code in the Province of Ontario, Canada, makes it mandatory that an air barrier be provided, which provides a continuous seal about the entire house. In the industry there is a move toward controlling the leakage for air changes in the building to a level of approximately 0.3 air changes per hour. The provision of the air barrier assists in controlling this change. The code however requires that where ever there is a joint between the air barrier and structural members that there be an overlap of at least 4" and at that joint adjacent floors, foundation walls and ceilings, and that the air barrier be taped, caulked or otherwise fastened, and overlapped 4 inches at the joint and taped. However it has been found that at the floor specifically, it is difficult to lap as the floor is a solid member which can not be bypassed easily and which therefore results in many contractors caulking around the joint where the air barrier meets the floor. This caulking is expensive and time consuming. The same problem occurs for joists which cross the barrier perpendicular to the extension of the barrier, which requires that the barrier be cut and taped or caulked. Specifically referring to Section 11 in the building code entitled "Insulation, Air Barriers and Vapour Barriers", the teachings of which are hereby incorporated by reference, there is referred to at page 11–10 and 11–12 the requirement for sealing.

Further, the general guidelines of the Hudak reference which is in essence a guideline for the warranty for home owners and contractors a like, prepared by the Ministry of Housing for the Province of Ontario, Canada. Section 9.25 entitled "Thermal Insulation and Control of Condensation" and specifically 9.25.3.4 entitled "Air Barrier Materials" is hereby incorporated by reference and the teachings thereof also in 9.25.5 "Installation of Air Barriers System". Again reference is to the joint between the floor, ceiling and roof areas as described above, and the requirement of the ceiling by lapping, caulking or taping. This new portion of the code took in effect Jan. 1, 1991.

Other inventors have attempted to solve this problem by providing a enclosure system for housing. Such a system is found in U.S. Pat. No. 4,843,786 and its equivalent Canadian Patent 1,230,461 which describes the use of a continuous barrier about a home. However, nowhere within this reference is there described a continuous air barrier formed by using a vapour barrier on the interior wall and supplementary portions extending from adjacent the interior wall to adjacent the exterior wall and returning again, around supporting members to adjacent the interior wall thus providing a continuous barrier to the elements.

U.S. Pat. No. 4,599,830 describes an energy saving building which includes a continuous barrier extending within the house and includes a tie plate and truss shoe which extends to the exterior wall of the house, as best seen in FIG. 1 of U.S. Pat. No. 4,559,830. Nowhere within this reference is there taught the method of construction which provides for supplementary portions used in conjunction with the vapour barrier and held in place by the vapour barrier with no other fastening which supplementary portion extends to the exterior wall from adjacent the interior wall and returning again by extending proximate supporting members back to the interior wall hence providing a continuous air permeable barrier as required by the code.

U.S. Pat. No. 4,194,328 describes a building which includes a continuous sheet of air vapour barrier extending from the building base, as best seen in relation to FIG. 3. A joint for the barrier is provided which barrier further covers the supporting members. However, the barrier is limited to the interior wall only and does not extend past the horizontal portions of the supporting members of the building to the outside wall and then extend back to the inside or interior wall along the next set of supporting members of the building.

United Kingdom Patent Application 2,136,844 describes a composite panel which has overlapped portions the composite panel being assembled with a membrane such as Tyvek (an air permeable membrane as known by those skilled in the art to meet building code requirements) (a Registered Trademark of the Dupont Corporation).

Nowhere within the prior are is there found a method of building a structure and the structure thereof which incorporates in combination a continuous barrier formed from the co-operation of the vapour barrier and supplementary portions, which are air permeable membranes, which extend proximate the floor and the foundation wall and preferably proximate the ceiling of the building structures. The supplementary portions extend from the interior wall along abutting adjacent structural members to the exterior wall and then extend to the next set of adjacent abutting portions thereof to return to the interior wall and being held in position only by the fastening together of the supporting members and the fastening of the vapour barrier over the overlapping portions of the air permeable membrane.

It is therefore a primary object of this invention to provide a method of construction for a building.

It is a further object of this invention to provide a structure resulting from practising the method of forming a building.

It is yet another object of this invention to provide a building which provides a continuous air permeable barrier for a building which is installed in a cost effective manner.

Further and other objects of this invention will become apparent to a man skilled in the art when considering the following summary of the invention and a more detailed description of the preferred embodiments illustrated herein.

SUMMARY OF THE INVENTION

According to a primary aspect of the invention there is provided a building having interior and exterior walls, the building comprising supporting members, a continuous vapour barrier and a continuous air barrier, the continuous air barrier being formed by the continuous vapour barrier with supplementary air permeable membrane portions positioned with the building when formed, the supplementary membrane portions extending between the interior and exterior walls extending between abutting supporting members disposed proximate the floor, foundation wall, and preferably the ceiling of the building when completed, the supplementary membrane portion continuously extending from under the cladding of the exterior wall to under the vapour barrier of the interior wall between the abutting supporting members, and thereby with the continuous vapour barrier providing a continuous air barrier for the building.

According to one aspect of the invention there is provided a method of building a structure, said structure when built including a substantially continuous air barrier and vapour barrier;

the method comprising;

1) Forming a building having an interior and exterior wall, the wall being defined by cladding disposed over installed supporting members such as joists and plates;
2) As the building is formed place an air permeable barrier having two ends between the supporting members proximate the substantially horizontal adjacent edges of the members such as the horizontally disposed plates and horizontally disposed joists, or alternatively between a second horizontally disposed plate in place of the joist, the ends of the air permeable barrier extending substantially beyond the interior and exterior walls of the building;
3) Joining the supporting members such as the joists and plates or alternatively the plates with the air barrier between the supporting members;
4) Ensuring an air permeable barrier is placed at least proximate the supporting members, such as the joists, proximate the foundation and further where the floors of the finished building abut, and preferably where the ceilings of the finished building abut.
5) Extending the end of the air permeable barrier disposed proximate the exterior wall upwardly along the exterior surface of the wall proximate the supporting members, such as joists and plates, and then extending the air permeable barrier inwardly along the adjacent edges of the next vertically disposed set of abutting supporting members, such as joists and plates or between adjacent edges of two plates, to beyond the interior wall and thereafter fastening the supporting members, such as the plates or joist and plate, together with one end of the air permeable barrier now extending upwardly proximate the interior wall of the building and the other end of the air permeable barrier extending downwardly proximate the first set of supporting members, such as plates and or joists. Repeating this step for each run of air permeable barrier installed with the building as necessary.
6) Fastening a vapour barrier with the interior wall of the building; the vapour barrier covering and securing the ends of the air permeable barrier disposed proximate each floor and preferably each ceiling and thereby securing the unfastened substantially unfastened ends of the air barrier (preferably providing at least 4 inches overlap with the vapour barrier proximate each floor and preferably each ceiling as well as proximate the foundation of the building).
7) Completing construction of said building.

Preferably the air permeable barrier is Tyvek (an air permeable membrane as known by those skilled in the art to meet building code requirements) (a registered Trademark of Dupont Corporation) or other equivalents. In one embodiment where the exterior cladding of the outer wall is present and is Tyvek (an air permeable membrane as known by those skilled in the art to meet building code requirements) (a registered Trademark of Dupont Corporation) covered, the air permeable barrier portion adjacent the ceiling may not be used. Further the ends of the air permeable barrier adjacent the foundation need not extend back to the interior wall at the next upwardly disposed supporting member, such as a joist or plate, but may terminate with an overlap of at least 4" with the Tyvek (an air permeable membrane as known by those skilled in the art to meet building code requirements) (a registered Trademark of Dupont Corporation) coated cladding.

According to another aspect of the invention there is provided a building structure, said structure when built including a substantially continuous air barrier and vapour barrier; the building structure comprising a building having an interior and exterior wall, the wall being defined by cladding disposed over installed supporting members such as joists and plates; an air permeable barrier having two ends disposed between the supporting members proximate the substantially horizontal adjacent edges of the members as the building is formed, such as the horizontally disposed plates and horizontally disposed joists, or alternatively between a second horizontally disposed plate in place of the joist, the ends of the air permeable barrier extending substantially beyond the interior and exterior walls of the building; wherein the supporting members, such as the joists and plates or alternatively the plates, are joined with the air barrier between the supporting members; an air permeable barrier being disposed at least proximate the supporting members, such as the joists or plates, proximate the foundation and further where the floors of the finished building abut, and preferably where the ceilings of the finished building abut, each air barrier extending, at the end of the air permeable barrier disposed proximate the exterior wall, upwardly proximate the exterior surface of the wall beneath the cladding proximate the supporting members, such as joists and plates, and the air permeable barrier then extending inwardly along the adjacent edges of the next vertically disposed set of abutting supporting members, such as joists and plates or between adjacent edges of two plates, to beyond the interior wall, the supporting members, such as the plates or joist and plate, together with one end of the air permeable barrier extending upwardly proximate the interior wall of the building and the other end of the air permeable barrier extending downwardly proximate the first set of supporting members, such as plates and or joists, a vapour barrier fastened with the interior wall of the building; the vapour barrier covering and securing the ends of the air permeable barrier disposed adjacent the interior wall proximate each floor and foundation and preferably each ceiling and being secured with the substantially unfastened ends of the air barrier (preferably providing at least 4 inches overlap with the vapour barrier proximate each floor and preferably each ceiling as well as proximate the foundation of the building).

Preferably the air permeable barrier is Tyvek (an air permeable membrane as known by those skilled in the art to meet building code requirements) (a registered Trademark of Dupont Corporation) or other equivalents. In one embodiment where the exterior cladding of the outer wall is present and is Tyvek (an air permeable membrane as known by those skilled in the art to meet building code requirements) (a registered Trademark of Dupont Corporation) covered, the air permeable barrier portion adjacent the ceiling may not be used. Further the ends of the air permeable barrier adjacent the foundation need not extend back to the interior wall at the next upwardly disposed supporting member, such as a joist or plate, but may terminate with an-overlap of at least 4" with the Tyvek coated cladding (an air permeable membrane as known by those skilled in the art to meet building code requirements).

BRIEF DESCRIPTION OF THE DRAWINGS

The invention will now be illustrated with respect to the following drawings illustrating embodiments of the invention in which.

DETAILED DESCRIPTION OF PREFERRED EMBODIMENTS OF THE INVENTION

Figure 1:
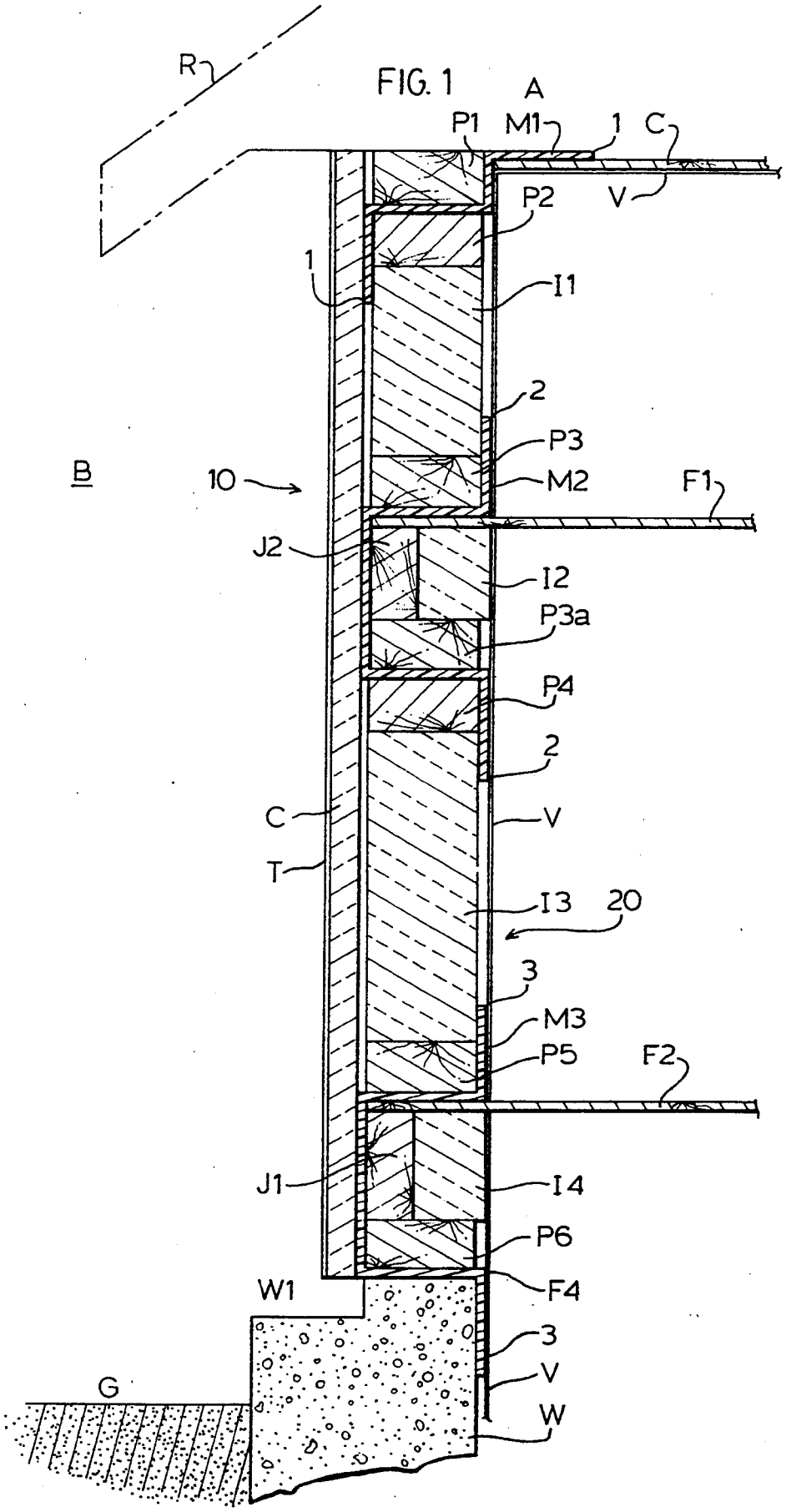
FIG. 1 is a cross sectional view of the wall of a building illustrated in a preferred embodiment of the invention.

Referring to the Figure, there is illustrated in cross-section a building B, and in this instance a residential dwelling. The residential dwelling is formed upon a concrete cast in place wall W, which includes a brick ledge W1. The manner in which the building is constructed is according to the housing code requirements and FIG. 1 is considered to be a cross-section schematic view only and in no way details the structural members of the building B. The main emphasize with the structure is the placement of the air permeable membranes M1, M2 and M3 at the locations shown. The air permeable membrane is made from Tyvek a Registered Trade Mark of the Dupont Corporation (an air permeable membrane as known by those skilled in the art to meet building code requirements). This material will allow air to pass as described in the code sections defined in the background of the invention. The gaps shown between the outer cladding C of exterior wall 10 and the joist and plates P1, P2, P3, P4, P5, P6, J1 and J2 are exaggerated in order to emphasize the path taken by the membranes M1, M2 and M3 when the building is constructed. The membrane thickness for M1, M2 and M3 is also exaggerated for explanative purposes.

The building is constructed and interior and exterior wall 10 and 20 are defined upon wall W above ground level G. Disposed between these interior and exterior walls 20 and 10 respectively, are disposed upper plates P1 and P2 as is known in the art located near the ceiling C of the building B. Plates P3 and joist J2 are disposed adjacent the top floor F1 of the building B. Plates P5 and joist J1 are disposed adjacent the floor F2 of the building B. Plate P6 is located adjacent the wall W and plate P4 is located below the plate P3A near the floor. Insulation I1, I2, I3 and I4 is disposed between the outer cladding C and the inter wall 20. The insulation I4 has an R8 value as recommended by code, the remaining insulation I1, I2 and I3 has a R factor 12 as defined by code.

The foundation wall W is formed with a brick ledge W1 for the support of brick facing, which is not shown for simplicity sake. Disposed above the membrane M3 between the plate P6 and the membrane M3 near the interior wall may be found a gasket made from foam under which the membrane runs.

The plates P1 through P6 respectively are 2" by 4" planks or alternatively 2" by 6" planks. The joists may be 2" by 8" planks or 2" by 10" planks or 2" by 12" planks as the application requires. The membrane M3 therefore extends from end to end from adjacent the foundation wall W between the top of the wall W and the plate P6 under any gasket which may be present, horizontally until inside of the cladding C the membrane M3 then running upwardly along the exterior surface of the plates P6 and the joist J1 to extend on the end of the floor plywood F2 and then extending inwardly along the top of the floor between the plate P5 and the joist J1 and then extending upwardly along the interior wall to the end 3. Similarly, the air permeable membrane M2 extends upwardly from end to end proximate the plate P4 and extends horizontally between plate P4 and plate P3A until the membrane extends upwardly inside the cladding C adjacent the exterior wall 10 and extends upwardly until it extends horizontally between the plate P3 and the joist J2 wherein the floor F1 is defined and then it extends vertically to end 2. Similarly the membrane M1 extends from the ceiling C proximate the top thereof, downwardly along the interior of the plate P1 then horizontally between the two plates P1 and P2 and then vertically downwardly toward end 1. In doing so and providing such a construction a vapour barrier V is then placed over the entire interior wall extending about the house to 2 feet below grade of the foundation wall W, as required by code. The membranes M1, M2 and M3 have not been fixed in anyway other than as the building is assembled and the plates and joist are connected by nailing or the like, the membrane located therebetween is fixed in place with the ends 1, 2 and 3 respectively being loose and untapped, unglued and uncaulked. When the vapour barrier V is placed over the overlapped ends 1, 2 and 3 adjacent the interior wall 20, this retains these ends in position when the vapour barrier is fasten by conventional methods. Further when the cladding is placed in position after the membranes M1, M2 and M3 are installed, the cladding retains the outer sections of the membranes in position.

The cladding C may be covered with Tyvek T (a registered Trademark of Dupont Corporation) (air permeable membrane as known by those skilled in the art to meet building code requirements) and in such an instance the membrane M1 and a portion of the membrane M3 above the middle of the joist J1 may be considered as redundant. These portions are not absolutely necessary to provide a continuous air barrier about the entire house, in such a situation wherein the air barrier is made up of the vapour barrier plus supplementary portions M1, M2 and M3 disposed adjacent the floor, ceiling and foundation wall of the building to ensure that the passage of air is provided only by a tortuous path.

The cladding may be considered glass clad, which is 1 inch thick and has an R value of 4.4, all joints of the glass clad cladding are taped to improve the thermal efficiency of the structure. As is the case if Tyvek (a registered Trademark of Dupont Corporation) (an air permeable membrane as known by those skilled in the art to meet building code requirements) is used in covering the exterior cladding then the membrane M2 is not necessary.

Therefore by providing runs of Tyvek (a registered Trademark of Dupont Corporation) (an air permeable membrane as known by those skilled in the art to meet building code requirements) type product as an air barrier with selective runs of glass clad covered by Tyvek (a registered Trademark of Dupont Corporation) (air permeable membrane as known by those skilled in the art to meet building code requirements) which is also consider an air barrier, one is able to provide a continuous air barrier without the need for caulking or taping or otherwise gluing or fastening the air barrier in position as described in the code found in the background of the invention. The Tyvek (a registered Trademark of Dupont Corporation) (an air permeable membrane as known by those skilled in the art to meet building code requirements) air permeable barrier is fasten when the vapour barrier is fasten by conventional methods.

The building is formed as follow; The foundation wall W is formed with a brick ledge W1. A section of membrane M3 is extends downwardly along the interior wail of the foundation wall W. The membrane preferably Tyvek (an air permeable membrane as known by those skilled in the art to meet building code requirements) (a registered Trademark of Dupont Corporation) then extends horizontally between the foundation wall covering any gasket that may be present, not shown, and extending under the plate P6 which is then fashioned with the wall by conventional methods. The joist J1 is then fastened to plate P6 and membrane M3 extends upwardly along the joist and extends inwardly above the floor F2 which is also fastened in position by the nailing of plate P5 which secures the membrane M3 as well, the end 3 of M3 extends upwardly and downwardly awaiting the assembly of the vapour barrier V. Similarly, the membrane M2 and M1 are installed. The insulation may then be placed in position, in the places indicated, and the vapour barrier is placed in position thereby completing the roughing in of the interior wall and ceiling.

Therefore, Applicant has provided a continuous air permeable membrane, when supplementary portions are used in conjunction with a vapour barrier which eliminates the need for taping, gluing or otherwise costly installation. Cutting of joints adjacent the plates and joists if the air barrier were restricted as is conventional to the interior wall only, is eliminated.

As can be readily understood from the drawing, the membrane may extends between any support structural member such as between the joists J2 and the plate P3A with equal success or alternatively between the joist J1 and the plate P6. The important thing is that the floors F1 and F2, the joint F4 at the foundation wall W, all provided only tortuous paths for any air leakage into the building.

As many changes can be made to the preferred embodiments without departing from the scope thereof; it is intended that all matter contained herein be considered illustrative of the invention and not in a limiting sense.

The embodiments of the invention in which an exclusive property or privilege is claimed are as follows:

1. A building having a floor, foundation wall and ceilings and having interior and exterior walls, the building comprising supporting members, a continuous vapour barrier extending proximate the interior walls and a continuous air barrier, the continuous air barrier being formed by the continuous vapour barrier with supplementary air permeable membrane portions positioned with the building when formed, the supplementary membrane portions extending between the interior, and exterior walls extending between abutting supporting members disposed proximate a floor, a foundation wall, and a ceiling of the building when completed, the supplementary membrane portion continuously extending from under cladding of the exterior wall to under a vapour barrier of the interior wall between the abutting supporting members, and thereby with the continuous vapour barrier providing a continuous air barrier for the building.

2. The building of claim 1 wherein the air, permeable barrier is an air permeable barrier as known by those skilled in the art to meet building code requirements.

3. The building of claim 1 wherein the exterior cladding of the outer wall is present and is covered with an air permeable barrier as known by those skilled in the art to meet building code requirements.

* * * * *